US011148160B2

(12) United States Patent
Pitchford

(10) Patent No.: US 11,148,160 B2
(45) Date of Patent: Oct. 19, 2021

(54) SPRAYER POST HOSE ATTACHMENT APPARATUS

(71) Applicant: Clanton Pitchford, Chicago, IL (US)

(72) Inventor: Clanton Pitchford, Chicago, IL (US)

( * ) Notice: Subject to any disclaimer, the term of this patent is extended or adjusted under 35 U.S.C. 154(b) by 22 days.

(21) Appl. No.: 16/822,943

(22) Filed: Mar. 18, 2020

(65) Prior Publication Data

US 2021/0291218 A1 Sep. 23, 2021

(51) Int. Cl.
*B05B 15/622* (2018.01)
*B05B 15/652* (2018.01)
*B05B 15/625* (2018.01)

(52) U.S. Cl.
CPC ..... *B05B 15/622* (2018.02); *B05B 15/625* (2018.02); *B05B 15/652* (2018.02)

(58) Field of Classification Search
CPC .... B05B 15/622; B05B 15/652; B05B 15/625
USPC ..... 239/273, 280, 588, 525, 589, 276
See application file for complete search history.

(56) References Cited

U.S. PATENT DOCUMENTS 515,625 A * 2/1894 Stott ..... B05B 1/185 239/276
727,465 A 5/1903 Scott
2,711,927 A 6/1955 Miller
2,819,115 A 1/1958 Arnold
2,852,307 A 9/1958 Clark
4,529,156 A * 7/1985 Heuer ..... B05B 15/622 239/276
7,866,570 B2 1/2011 Griffin
7,871,022 B1 * 1/2011 Plyler ..... B05B 15/62 239/588
8,453,948 B2 6/2013 Altail
9,022,300 B2 * 5/2015 Nies ..... B05B 15/622 239/276
2010/0006669 A1 * 1/2010 Thompson ..... B05B 15/622 239/200

FOREIGN PATENT DOCUMENTS

WO WO2011033501 3/2011

* cited by examiner

*Primary Examiner* — Steven J Ganey

(57) ABSTRACT

A sprayer post hose attachment apparatus for aquatic enjoyment and irrigation includes a support post having a post bottom end and a post top end. The support post is configured to be partially inserted into the ground. A T-joint is coupled to the support post. The T-joint has a bottom aperture coupled to the support post, an input aperture, and an output aperture. A hose attachment arm is coupled to the T-joint. The hose attachment arm has an arm proximal end coupled to the input aperture of the T-joint and an arm distal end to selectively receive a hose. A riser tube is coupled to the T-joint. The riser tube has a riser bottom end coupled to the output aperture of the T-joint and a riser top end. A spray nozzle is coupled to the riser tube. The spray nozzle is coupled to the riser top end.

9 Claims, 5 Drawing Sheets

SPRAYER POST HOSE ATTACHMENT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hose attachment devices and more particularly pertains to a new hose attachment device for aquatic enjoyment and irrigation.

(2) Description of Related Art Including Information Disclosed Under 37 CFR 1.97 and 1.98

The prior art relates to hose attachment devices that typically provide a fixed attachment low to the ground. Such devices often have a rotational element for even distribution of water. Existing devices lack a tall, rigid riser and a flexible gooseneck upper portion to direct the spray as desired.

BRIEF SUMMARY OF THE INVENTION

An embodiment of the disclosure meets the needs presented above by generally comprising a support post having a post bottom end and a post top end. The support post is configured to be partially inserted into the ground. A T-joint is coupled to the support post. The T-joint has a bottom aperture coupled to the support post, an input aperture, and an output aperture. A hose attachment arm is coupled to the T-joint. The hose attachment arm has an arm proximal end coupled to the input aperture of the T-joint and an arm distal end configured to selectively receive a hose. A riser tube is coupled to the T-joint. The riser tube has a riser bottom end coupled to the output aperture of the T-joint and a riser top end. A spray nozzle is coupled to the riser tube. The spray nozzle is coupled to the riser top end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
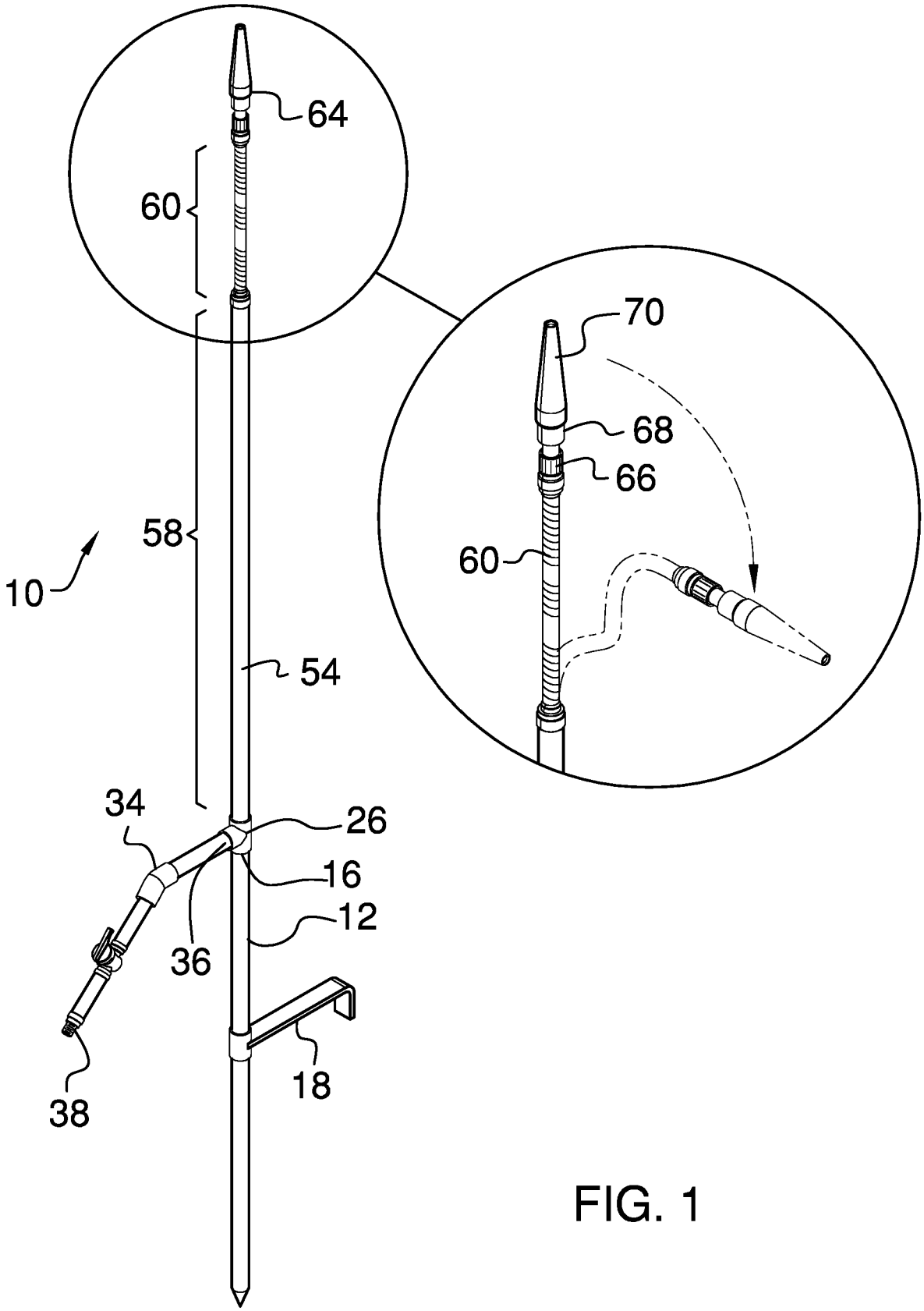
FIG. 1 is an isometric view of a sprayer post hose attachment apparatus according to an embodiment of the disclosure.
Figure 2:
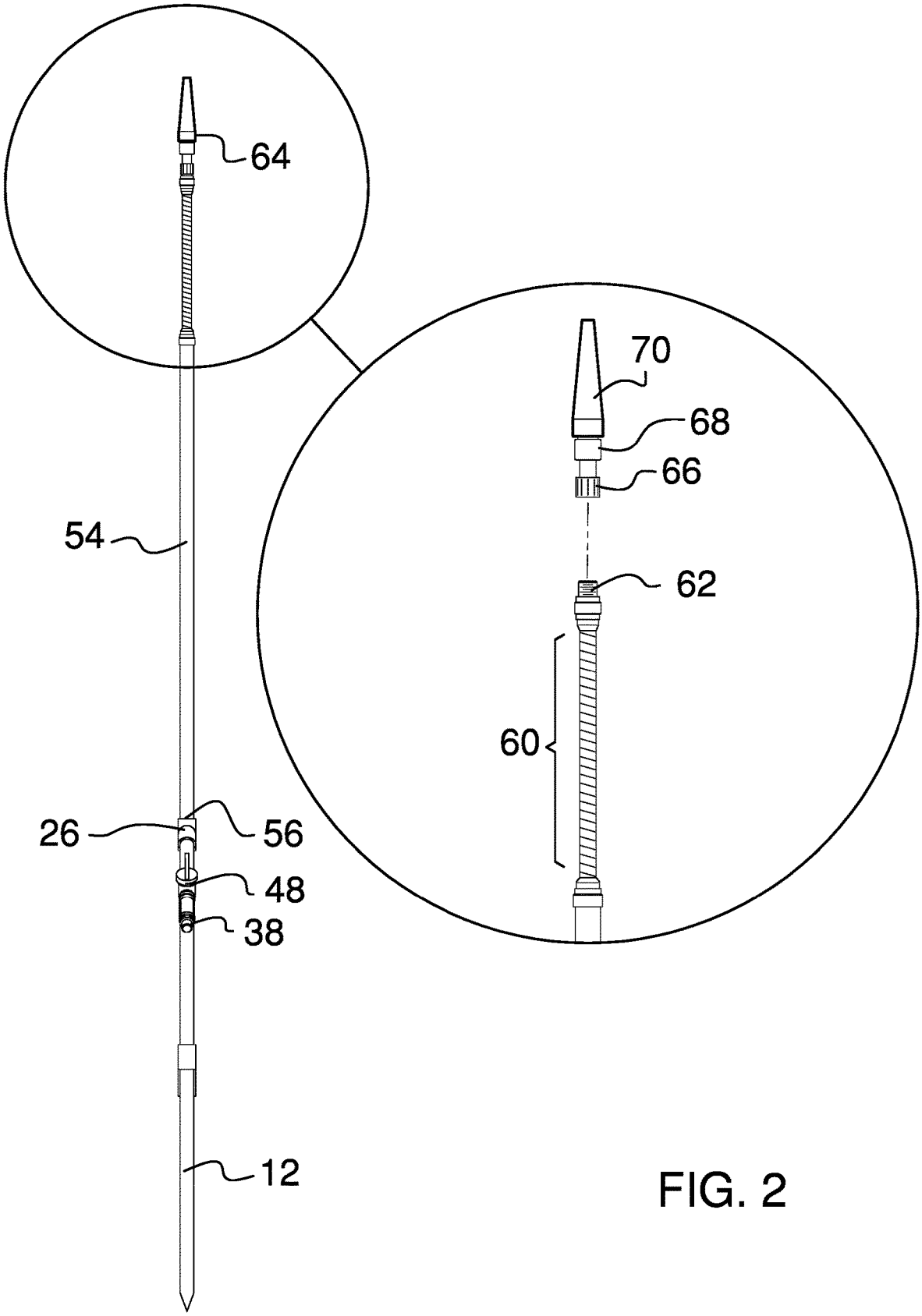
FIG. 2 is a front elevation view of an embodiment of the disclosure.
Figure 3:
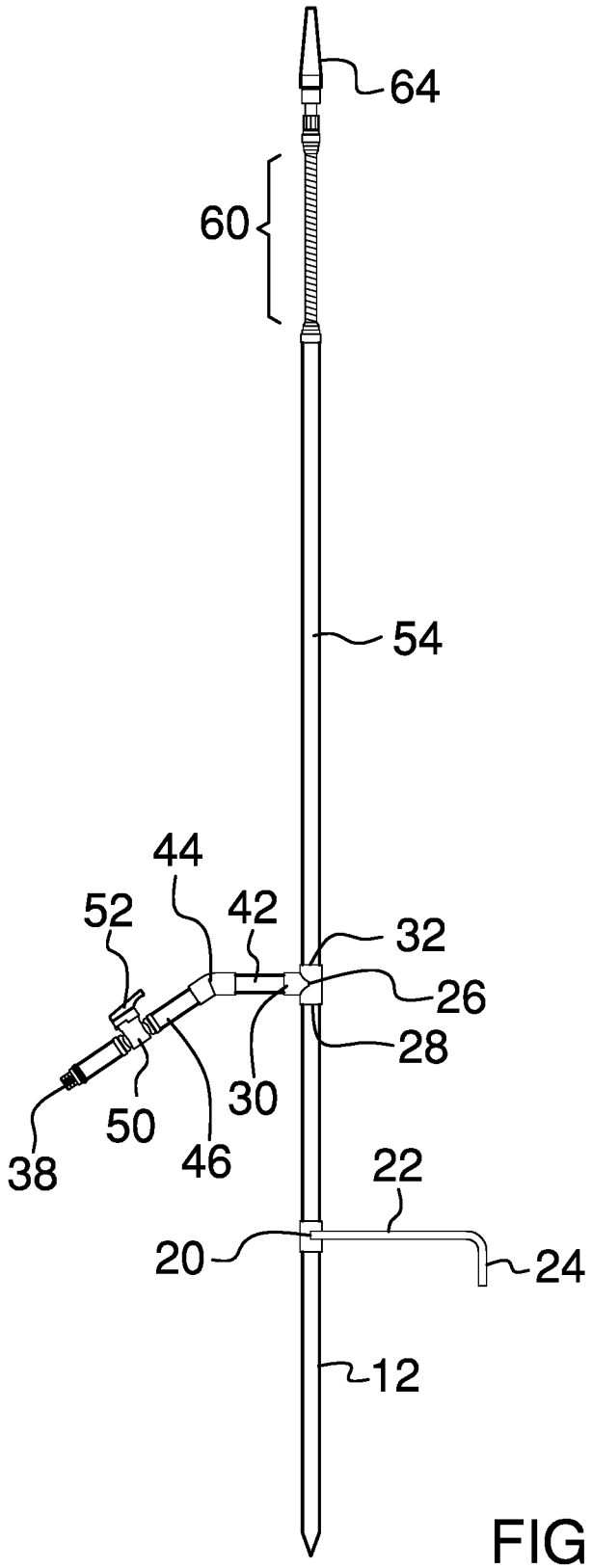
FIG. 3 is a side elevation view of an embodiment of the disclosure.
Figure 4:
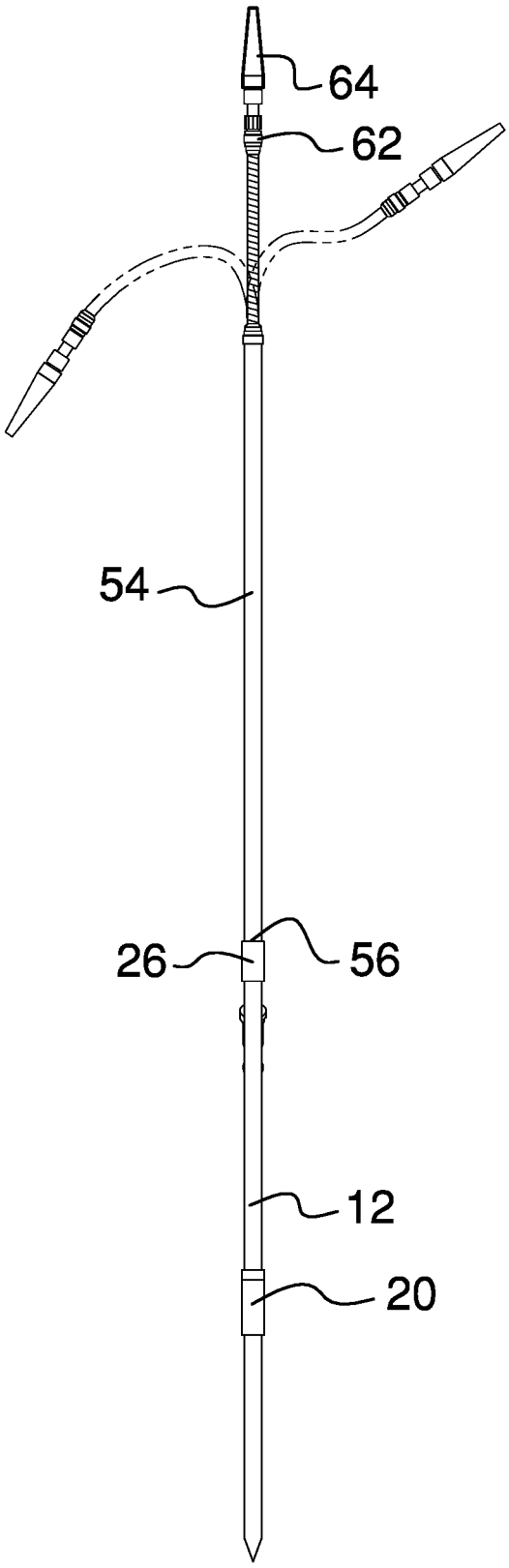
FIG. 4 is a rear elevation view of an embodiment of the disclosure.
Figure 5:
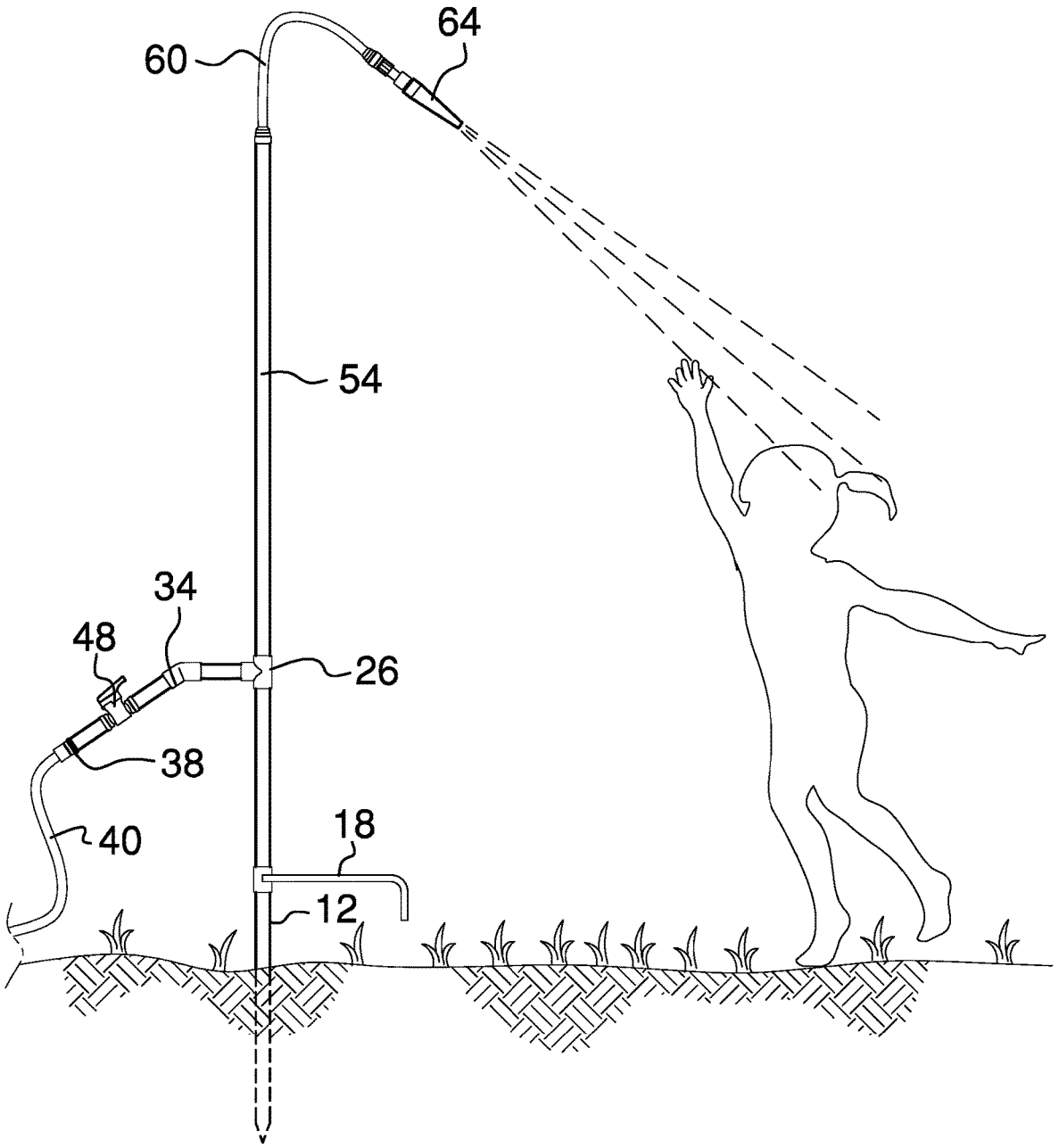
FIG. 5 is an in-use view of an embodiment of the disclosure.

With reference now to the drawings, and in particular to FIGS. 1 through 5 thereof, a new hose attachment device embodying the principles and concepts of an embodiment of the disclosure and generally designated by the reference numeral 10 will be described.

As best illustrated in FIGS. 1 through 5, the sprayer post hose attachment apparatus 10 generally comprises a support post 12 having a spiked post bottom end 14 and a post top end 16. The support post 12 is configured to be partially inserted into the ground to maintain the support post 12 in a vertical position. A support foot 18 may be coupled to the support post 12. The support foot 18 has an attachment portion 20 coupled to the support post 12, a horizontal medial portion 22, and a vertical end portion 24. The vertical end portion 24 is configured to be inserted into the ground to provide stability to the support post 12.

A T-joint 26 is coupled to the support post 12. The T-joint 26 has a bottom aperture 28 coupled to the post top end 16, an input aperture 30, and an output aperture 32. The input aperture 30 and the output aperture are in fluid communication and are separated from the bottom aperture 28. The bottom aperture 28 and the output aperture 32 are coaxially aligned and the input aperture 30 may extend perpendicularly.

A hose attachment arm 34 is coupled to the T-joint 26. The hose attachment arm 34 has an arm proximal end 36 coupled to the input aperture 30 of the T-joint and an arm distal end 38 configured to selectively receive a hose 40. The arm distal end 38 is thus in fluid communication with output aperture 32. The hose attachment arm 34 may have a horizontal proximal portion 42 extending from the arm proximal end 36, an angled elbow 44 coupled to the horizontal proximal portion 42, and an extension portion 46 coupled to the angled elbow 44. The angled elbow 44 directs the extension portion 46 towards to ground to prevent kinks in the hose 40 and may form an angle of 120°. A flow control valve 48 may be coupled to the hose attachment arm 34. The flow control valve 48 may be coupled to the extension portion 46 and may include a valve housing 50 and a valve lever 52. The valve lever 52 may be rotated to gradually control the flow from the hose 40 from fully blocked to fully open.

A riser tube 54 has a riser bottom end 56 coupled to the output aperture 32 of the T-joint. The riser tube 54 has a rigid portion 58 extending from the riser bottom end 56 and a flexible portion 60 extending from the rigid portion 58 to a riser top end 62. The flexible portion 60 may be a semi-rigid tubing that is flexible yet retains its shape, such as gooseneck tubing and the like. The riser top end 62 may be threaded.

A spray nozzle 64 is coupled to the riser tube 54. The spray nozzle 64 may have a threaded attachment portion 66 to selectively engage the riser top end 62, a fixed portion 68 coupled to the threaded attachment portion 66, and a tip portion 70 rotatably coupled to the fixed portion 68. The tip portion 70 adjusts the sprayer pattern emitted from the spray nozzle 64 as it is rotated relative the fixed portion 68 to create anything from strong directional patterns to wide misting patterns. The tip portion 70 may be a truncated conical shape.

In use, the spiked post bottom end 14 is inserted into the ground until the vertical end portion 24 of the support foot is also inserted into the ground. The hose 40 is then attached to the arm distal end 38 of the hose attachment arm and the flow control valve 48 is manipulated as desired. The flexible portion 60 of the riser tube is bent to direct the spray nozzle 64 and the tip portion 70 is rotated to control the spray pattern.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sprayer post hose attachment apparatus comprising:

a support post, the support post having a post bottom end and a post top end, the support post being configured to be partially inserted into the ground;

a T-joint coupled to the support post, the T-joint having a bottom aperture coupled to the support post, an input aperture, and an output aperture;

a hose attachment arm coupled to the T-joint, the hose attachment arm having an arm proximal end coupled to the input aperture of the T-joint and an arm distal end configured to selectively receive a hose;

a riser tube coupled to the T-joint, the riser tube having a riser bottom end coupled to the output aperture of the T-joint and a riser top end;

a spray nozzle coupled to the riser tube, the spray nozzle being coupled to the riser top end;

a flow control valve coupled to the hose attachment arm; and the hose attachment arm having a horizontal proximal portion extending from the arm proximal end, an angled elbow coupled to the horizontal proximal portion, and an extension portion coupled to the angled elbow; the flow control valve being coupled to the extension portion.

2. The sprayer post hose attachment apparatus of claim 1 further comprising the post bottom end being spiked.

3. The sprayer post hose attachment apparatus of claim 1 further comprising a support foot coupled to the support post.

4. The sprayer post hose attachment apparatus of claim 3 further comprising the support foot having an attachment portion coupled to the support post, a horizontal medial portion, and a vertical end portion, the vertical end portion being configured to be inserted into the ground.

5. The sprayer post hose attachment apparatus of claim 1 further comprising the riser tube having a rigid portion extending from the riser bottom end and a flexible portion extending from the rigid portion to the riser top end.

6. The sprayer post hose attachment apparatus of claim 5 further comprising the flexible portion being gooseneck tubing.

7. The sprayer post hose attachment apparatus of claim 1 further comprising the riser top end being threaded; the spray nozzle having a threaded attachment portion to selectively engage the riser top end, a fixed portion coupled to the threaded attachment portion, and a tip portion, rotatably coupled to the fixed portion, the tip portion adjusting the spray pattern emitted from the spray nozzle as rotated relative the fixed portion.

8. The sprayer post hose attachment apparatus of claim 7 further comprising the tip portion being a truncated conical shape.

9. A sprayer post hose attachment apparatus comprising:

a support post, the support post having a spiked post bottom end and a post top end, the support post being configured to be partially inserted into the ground;

a support foot coupled to the support post, the support foot having an attachment portion coupled to the support post, a horizontal medial portion, and a vertical end portion, the vertical end portion being configured to be inserted into the ground;

a T-joint coupled to the support post, the T-joint having a bottom aperture coupled to the support post, an input aperture, and an output aperture;

a hose attachment arm coupled to the T-joint, the hose attachment arm having an arm proximal end coupled to the input aperture of the T-joint and an arm distal end configured to selectively receive a hose, the hose attachment arm having a horizontal proximal portion extending from the arm proximal end, an angled elbow coupled to the horizontal proximal portion, and an extension portion coupled to the angled elbow;

a flow control valve coupled to the hose attachment arm, the flow control valve being coupled to the extension portion;

a riser tube coupled to the T-joint, the riser tube having a riser bottom end coupled to the output aperture of the T-joint, the riser tube having a rigid portion extending from the riser bottom end and a flexible portion extending from the rigid portion to a riser top end, the flexible portion being gooseneck tubing, the riser top end being threaded; and a spray nozzle coupled to the riser tube, the spray nozzle having a threaded attachment portion to selectively engage the riser top end, a fixed portion coupled to the threaded attachment portion, and a tip portion rotatably coupled to the fixed portion, the tip portion adjusting the spray pattern emitted from the spray nozzle as rotated relative the fixed portion, the tip portion being a truncated conical shape.

* * * * *